US010596806B2

(12) United States Patent
Neeb et al.

(10) Patent No.: US 10,596,806 B2
(45) Date of Patent: Mar. 24, 2020

(54) METHOD FOR DETECTING AND COMPENSATING FOR DEFECTIVE PRINTING NOZZLES IN AN INK JET PRINTING MACHINE

(71) Applicant: HEIDELBERGER DRUCKMASCHINEN AG, Heidelberg (DE)

(72) Inventors: Steffen Neeb, Bensheim (DE); Nicklas Raymond Norrick, Heddesheim (DE); Andreas Henn, Neckargemuend (DE); Andreas Fehlner, Mannheim (DE); Thomas Wolf, Heidelberg (DE); Jens Forche, Mannheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 16/161,141

(22) Filed: Oct. 16, 2018

(65) Prior Publication Data

US 2019/0160809 A1 May 30, 2019

(30) Foreign Application Priority Data

Nov. 24, 2017 (DE) ..... 10 2017 221 035

(51) Int. Cl.
*B41J 2/21* (2006.01)
*B41J 2/045* (2006.01)
*B41J 25/00* (2006.01)

(52) U.S. Cl.
CPC ..... *B41J 2/0451* (2013.01); *B41J 2/04586* (2013.01); *B41J 2/2139* (2013.01); (Continued)

(58) Field of Classification Search
CPC ..... B41J 2/0451; B41J 2/2139; B41J 2/2142; B41J 2/2146; B41J 2/04586; B41J 2025/008
See application file for complete search history.

(56) References Cited

U.S. PATENT DOCUMENTS 6,238,112 B1 5/2001 Girones et al.
7,327,503 B2 2/2008 Yashima et al.
(Continued)

FOREIGN PATENT DOCUMENTS

DE 69908289 T2 4/2004
DE 60209287 T2 11/2006

*Primary Examiner* — Yaovi M Ameh
(74) *Attorney, Agent, or Firm* — Laurence A. Greenberg; Werner H. Stemer; Ralph E. Locher

(57) ABSTRACT

A method for detecting and compensating for defective printing nozzles in an ink jet printing machine by using a computer includes printing printing nozzle test charts next to an actual print in a production run, subsequently recording and digitizing the printed printing nozzle test charts by using at least one image sensor, evaluating recorded test charts and, based thereon, defining characteristic values for all printing nozzles contributing to the printed printing nozzle test charts by using the computer, calculating a failure probability for every contributing printing nozzle based on the determined characteristic values by applying a statistical prediction model using the computer, and switching off and compensating for all printing nozzles exceeding a first defined threshold for the calculated failure probability. A printing operation is then carried out on the ink jet printing machine with printing nozzle compensation.

9 Claims, 6 Drawing Sheets

(52) U.S. Cl.
CPC ..... *B41J 2/2142* (2013.01); *B41J 2/2146* (2013.01); *B41J 2025/008* (2013.01)

(56) References Cited

U.S. PATENT DOCUMENTS

2012/0250040 A1* 10/2012 Yamazaki ..... B41J 2/2142
358/1.8
2013/0208042 A1* 8/2013 Ueshima ..... B41J 29/393
347/19

* cited by examiner

METHOD FOR DETECTING AND COMPENSATING FOR DEFECTIVE PRINTING NOZZLES IN AN INK JET PRINTING MACHINE

CROSS-REFERENCE TO RELATED APPLICATION

This application claims the priority, under 35 U.S.C. § 119, of German Patent Application DE 10 2017 221 035.4, filed Nov. 24, 2017; the prior application is herewith incorporated by reference in its entirety.

BACKGROUND OF THE INVENTION

Field of the Invention

The invention relates to a method for detecting and compensating for defective printing nozzles in an ink jet printing machine in which defective printing nozzles are predicted by using a prediction model.

The technical field of the invention is the field of digital printing.

The quality which an ink jet printing machine, in particular an industrial large-format ink jet printing machine, can deliver always depends on the performance of the individual printing nozzles of the ink jet print heads that are used. The performance of individual printing nozzles may deteriorate until the nozzle fails completely. Such a failure may be caused by foreign bodies such as dust particles entering the nozzle or by dried-on ink residues that clog the nozzle in particular if the ink jet print heads have not been used for a longer period of time. Both causes of defects result in partial or total nozzle opening blockages, which make the affected printing nozzles unable to jet the intended amount of ink in the form of jetted ink droplets. In addition, if the printing nozzle is partly clogged or blocked, the dot it prints may be offset from the intended position, i.e. the nozzle may jet at an angle. Such a nozzle performance glitch results in artifacts in the print that they create, for instance in white lines in the case of a failed nozzle or, in the case of printing nozzles that jet at an angle, in white lines where the print dot of the nozzle in question should have been and a black line where the printing nozzle that jets at an angle misplaces ink and thus contributes to an undesired application of too much ink at that location. Such defective printing nozzles that create image artifacts in the form of white lines and black lines are summarily referred to as missing nozzles.

In order to be able to continue to use an affected ink jet print head in which such missing nozzles occur and to avoid having to resort to the costly measure of changing the ink jet print heads whenever individual missing nozzles occur, several compensation processes for missing nozzles have become known in the art. Among other approaches, such compensation strategies include the provision of redundant printing nozzles and print heads for the same printing color and, in the case of multicolor prints, the replacement of missing nozzles by printing nozzles that print different printing colors at the location of the missing nozzle in the printed image. When defective printing nozzles have been identified, another approach is to adapt the print prior to the screening process in such a way as to minimize the number of artifacts that the missing nozzles will later create in the print. The adaptions may include adapting gray values in the digital print image in the region that the missing nozzles will produce after the screening process and offsetting entire image objects in the digital print for imposition.

The most common approach when defective printing nozzles have been identified is, however, to adapt the screened print in such a way that the ink jet printing machine is actuated in a way for printing nozzles next to the missing nozzle to jet more ink to compensate for the defective printing nozzle.

However, to be able to compensate for defective printing nozzles, they need to be detected first. Again, a variety of detection methods have become known in the art. They may be broadly divided into two different approaches. The first approach is to provide an image recording system with at least one image sensor for continuously scanning the printed image, to digitize the printed image, to feed the data to a computer that evaluates the digitized images and examines them to find potential missing nozzles. The computer will then forward the results of the evaluation to where measures are taken to compensate for the missing nozzles that have occurred. A disadvantage of that approach is that in an evaluation of the images that are currently printed in a production run on the printing machine, defective printing nozzles may frequently not be detected because they may not contribute to the current print, for instance. In addition, the print data to be produced in the actual print are rarely suitable for detecting defective printing nozzles in an optimum way.

Another approach to detecting defective printing nozzles is thus to print printing nozzle test charts that have been specifically optimized for detecting defective printing nozzles. Those test charts are printed onto the printing substrate in addition to the actual print that is to be created and are subsequently evaluated by the aforementioned image recording system. A disadvantage of that method is that it requires additional image data to be created on the substrate, slightly increasing the performance and workload of the ink jet printing machine. Another aspect to be considered is that the detection charts require a certain amount of space on a print sheet or in a label section and need to be printed individually for every color.

In general, when printing nozzle test charts are printed, every printing nozzle prints small image objects such as short vertical lines that will then be examined in the course of a detection process carried out by the evaluation computer of the image recording system. The characteristics of an image object that has been created by an individual nozzle then allows conclusions to be drawn about the performance of the nozzle in question. The evaluation relies on thresholds that define how long a nozzle is considered to be functioning and from which point it is to be considered defective. Depending on those thresholds, a decision is made whether to switch a printing nozzle off or on again. The quality of every individual nozzle needs to be known for the comparison. It is described by specific characteristic values such as the clarity, slope, or gray value of the vertical line printed by the respective printing nozzle. The characteristic values are determined at defined intervals on the fly, i.e. during an ongoing printing operation. In accordance with the prior art, the characteristic values are categorized on the basis of empirical values. Printing nozzles having values which exceed a specific threshold are switched off. They may be switched on again when a certain number of successive detections, for instance 5, provide results below the threshold. The methods that are currently known do not provide any forecast or prediction of nozzle quality. However, a printing nozzle is only switched off when the quality threshold is reached or exceeded. As a consequence, a threshold that is too tolerant will result in the production of waste, and a threshold that is too sensitive will result in a premature switching off of printing nozzles, which in turn results in unnecessary compensation. Both phenomena have a negative impact on the quality and/or performance of the ink jet printing machine.

SUMMARY OF THE INVENTION

It is accordingly an object of the invention to provide a method for detecting and compensating for defective printing nozzles in an ink jet printing machine, which overcomes the hereinafore-mentioned disadvantages of the heretofore-known methods of this general type and which provides a more efficient and more effective method for controlling the quality of an ink jet printing machine by monitoring the performance of the printing nozzles.

With the foregoing and other objects in view there is provided, in accordance with the invention, a method for detecting and compensating for defective printing nozzles in an ink jet printing machine by using a computer, the method comprising the steps of printing printing nozzle test charts next to the actual print in the production run, subsequently recording and digitizing the printed printing nozzle test charts by using at least one image sensor, evaluating the recorded test charts, and, based thereon, defining characteristic values for all printing nozzles that contribute to the printing of the printing nozzle test charts by using the computer, calculating a failure probability for every contributing printing nozzle based on the determined characteristic values by applying a statistic prediction model by using the computer, switching off and compensating for all printing nozzles that exceed a first defined threshold for the calculated failure probability, and carrying out a printing operation on the ink jet printing machine with printing nozzle compensation.

A key element of the method of the invention is that not only does it monitor the print for printing nozzle failures, but it also checks the entire state of all printing nozzles that contribute to the print to assess their performance. The current state of the printing nozzles is defined on the basis of characteristic values that are directly derived from the printed printing nozzle test chart including individual image objects for every individual printing nozzle. Based on this current state of the individual printing nozzles, a statistic prediction model is used to calculate the failure probability of every single printing nozzle. If the calculated failure probability of a printing nozzle exceeds a specified threshold, the printing nozzle is deactivated. Of course, the deactivated printing nozzle will then create a white line in the actual print, which means that it needs to be compensated for in a suitable way. The reason for switching off printing nozzles that have been found defective even though they may not have failed completely and may still be partly functional or jet at an angle is that a defined starting condition is needed for compensation purposes. This defined starting condition may be created by switching off nozzles that do no longer perform correctly. If this was not done and a printing nozzle that prints to a reduced extent was allowed to continue to print despite compensation measures, a dedicated compensatory approach adapted to the specific defect characteristics would have to be found for every single printing nozzle that prints with a defect. That would make the compensation process much more complicated. Thus, nozzles that are defective in this way are intentionally switched off. However, in the method of the invention, the key parameter to decide whether a printing nozzle is to be switched off is not the actual current condition of the printing nozzle, but the individual nozzle's failure probability that has been calculated in accordance with the invention. If it exceeds the threshold, the nozzle is switched off. If it does not exceed the threshold, the nozzle may be allowed to go on printing. An advantage of this approach is that printing nozzles that are highly likely to fail soon will be proactively treated and compensated for. In contrast to the prior art, the method of the invention does not wait until a printing nozzle actually fails and thus potentially produces waste, but rather takes preemptive action.

Advantageous and thus preferred further developments of the method will become apparent from the associated dependent claims and from the description together with the associated drawings.

Another preferred development of the method of the invention in this context is that the printing nozzle test chart is printed in such a way that it is formed of a specified number of horizontal rows of equidistant vertical lines that are printed periodically and are disposed underneath one another, wherein in every row of the nozzle test chart only those printing nozzles of the print head in the ink jet printing machine that correspond to the specified number of horizontal rows periodically contribute to the first element of the printing nozzle test chart. Many types of printing nozzle test charts are known. A particularly suitable type is formed of a specified number of horizontal rows with equidistant lines or stripes printed vertically. Since image sensors that use current sensor technology have a significantly lower resolution than the actual print that is produced, not all neighboring printing nozzles may print directly next to one another because the at least one image sensor does not have the required resolution to distinguish between these individual lines. Consequently, only every tenth vertical line, for instance, is printed by the corresponding printing nozzle in a horizontal row. In order to include all printing nozzles and allow them to print their vertical lines, the printing nozzle test chart is formed of a total of ten horizontal rows.

A further preferred development of the method of the invention in this context is that the characteristic values include the thickness, slope and color value of the vertically printed equidistant lines as well as the utilized capacity of the contributing nozzles. The corresponding characteristic values to be used for assessing the current performance of the tested printing nozzles are, among others, the thickness, angle, and color value of the vertically printed lines as indicated above. Naturally, these values also apply if other types of printing nozzle test charts are used. In such a case, however, the characteristic values would potentially have to be adapted to the different form of the individual image objects in the form of the vertical lines that are printed in the test chart by the printing nozzles. An important aspect is that the utilized capacity of the contributing printing nozzles is included as a characteristic value because the performance of the individual printing nozzles is particularly dependent on the utilized capacity thereof.

An added preferred development of the method of the invention in this context is that the failure probability of every printing nozzle represents the probability of the respective printing nozzle to exceed a tolerance for the print quality resulting from the characteristic values. While the decision whether a printing nozzle is deactivated and needs to be compensated for is made by assessing whether the failure probability exceeds a specified threshold, the failure probability itself is defined by assessing whether the performance of a specific printing nozzle as indicated by the characteristic values exceeds a defined threshold for these characteristic values. Thus, the probability for the current characteristic values of a printing nozzle to exceed the tolerances for these characteristic values is established.

An additional preferred development of the method of the invention in this context is that to apply the prediction model, the characteristic values are established multiple times for every printing nozzle, with every assessment of a printed printing nozzle test chart corresponding to one pass, and the characteristic values that have been established multiple times in this way are saved and used to calculate the failure probability. In order to maximize the accuracy of the characteristic values and thus to be able to apply the prediction model as accurately as possible, it is expedient to establish the characteristic values that indicate the current state of every single printing nozzle multiple times. This is done by printing the printing nozzle test chart multiple times, evaluating it multiple times by using the image recording system, and saving the results for further use when the failure probability is calculated. In this context it should be noted that determining the characteristic values multiple times to describe the current state is expedient on one hand because averaging the characteristic values that have been established multiple times may eliminate individual measurement errors and on the other hand especially because it allows the actual progression of the characteristic values to be visualized over time. This progression over time is an important criterion to be able to prognosticate the future progression of the characteristic values and thus the performance of the printing nozzle.

Another preferred development of the method of the invention in this context is that the characteristic values that have been established multiple times are used as a function of the process variation of the characteristic values over their progression in the individual passes, wherein for the same failure probability, progressions with lower process variation of the characteristic values are allowed to get closer to the tolerance limit than progressions with greater process variation. If one considers the progression of the established characteristic values over time, the corresponding process variation of the characteristic values will have to be factored in. This means that characteristic values that fluctuate considerably, i.e. that vary, contain a much greater uncertainty factor. A reason for such variation may of course be measurement errors on one hand and a printing nozzle that is actually highly volatile in terms of its print quality. The key aspect is that in terms of the further progression of its characteristic values that is to be predicted, a printing nozzle having characteristic values which fluctuate to a considerable extent has immediate consequences for the determination of the failure probability. The progression of the characteristic values of a printing nozzle that exhibits only little variation is thus allowed to get much closer to the tolerance limit because statistically one may assume that the future development of the characteristic values will be subject to little variation and thus the probability of the characteristic values exceeding the tolerance is much lower than if the progression of the characteristic values varies to a greater extent. Conversely, this means that on average, a characteristic value progression that varies to a great extent must not be allowed to get close to the tolerance limit because in such a case the future development must be expected to vary greatly too, resulting in a much greater probability for individual characteristic values to exceed the tolerance if the values were allowed to get closer to the tolerance limit. In the end, this means that for the same resultant failure probability, characteristic value progressions of low variation may be allowed to get closer to the tolerance limit than progressions with greater variation.

A further preferred development of the method of the invention in this context is that the characteristic values that have been established multiple times are converted into statistic process factors in the form of an expectation value and a confidence interval and the statistic process factors are determined by linear or non-linear regression of the characteristic values that have been determined multiple times, with a regression model of any desired order being used for the linear or non-linear regression. The determined characteristic values that describe the current state of the printing nozzle may be converted into statistic process factors such as the expectation value and a confidence interval. They are determined by linear or non-linear regression of the characteristic values. A model of any desired order may be used for the regression. A model of the first order, for instance, means linear regression. A model of zero order means no regression, i.e. the statistic variables accordingly correspond to the average and standard deviation of expectation value and confidence interval.

An added preferred development of the method of the invention in this context is that the statistic variables are formed with a time-based weighting of the characteristic values that have been established multiple times, wherein the time-based weighting occurs in such a way that newer characteristic values are given linearly or exponentially more weight than older characteristic values. Thus, when the statistic process factors to be used in a future calculation of the failure probability are established, a time-based weighting of the characteristic values that have been established multiple times is to be made. This time-based weighting means that newer characteristic values are given a greater weight than older characteristic values. If it is applied, it may be a linear or exponential weighting, which means that for a linear weighting, the weight of the core values increases more linearly the newer they are while for an exponential weighting, the significance of the core values increases exponentially.

An additional preferred development of the method of the invention in this context is that printing nozzles that have been switched off for the printing of an image continue to contribute to the printing of the printing nozzle test chart, the failure probability continues to be calculated for these printing nozzles and, when the calculated failure probability remains below a second defined threshold, these printing nozzles are used again to print the image in the production run. An important aspect of the method of the invention is that due to the prediction of the future behavior of the contributing printing nozzles, the printing nozzles are continuously monitored in terms of their current state. This also applies to printing nozzles that exceed a failure probability threshold and are thus deactivated. This means that the printing nozzles are only deactivated for the actual print, i.e. the image to be printed, while they continue to contribute to the printing of the printing nozzle test chart. Thus, they continue to be monitored in terms of their performance even when they have been switched off for the print. If their characteristic values and thus their performance change, for instance if their failure probability sinks below the threshold due to a lower utilized capacity, these printing nozzles may again be used to print the actual print in the production run to complete the actual print job. In this context, the failure probability thresholds that determine whether a printing nozzle needs to be deactivated and thus compensated for or whether it may be reactivated for the production run are two different parameters. They may have an identical value though.

A concomitant preferred development of the method of the invention in this context is that to calculate the failure probability of all printing nozzles that contribute to the printing of the printing nozzle test charts, multimodal distributions of the characteristic values are assumed and used apart from a unimodal distribution. Apart from the standard unimodal distribution, the distribution may include bimodal distributions or multimodal distributions in general. This refers to the probability distribution of the occurrence of individual characteristic values for which one or more statistic modes may correspondingly be assumed, and the corresponding consequences for the evaluation to determine the failure probability.

The invention as such as well as further developments of the invention that are advantageous in structural and/or functional terms will be described in more detail below with reference to the associated drawings and based on at least one preferred exemplary embodiment.

Other features which are considered as characteristic for the invention are set forth in the appended claims.

Although the invention is illustrated and described herein as embodied in a method for detecting and compensating for defective printing nozzles in an ink jet printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
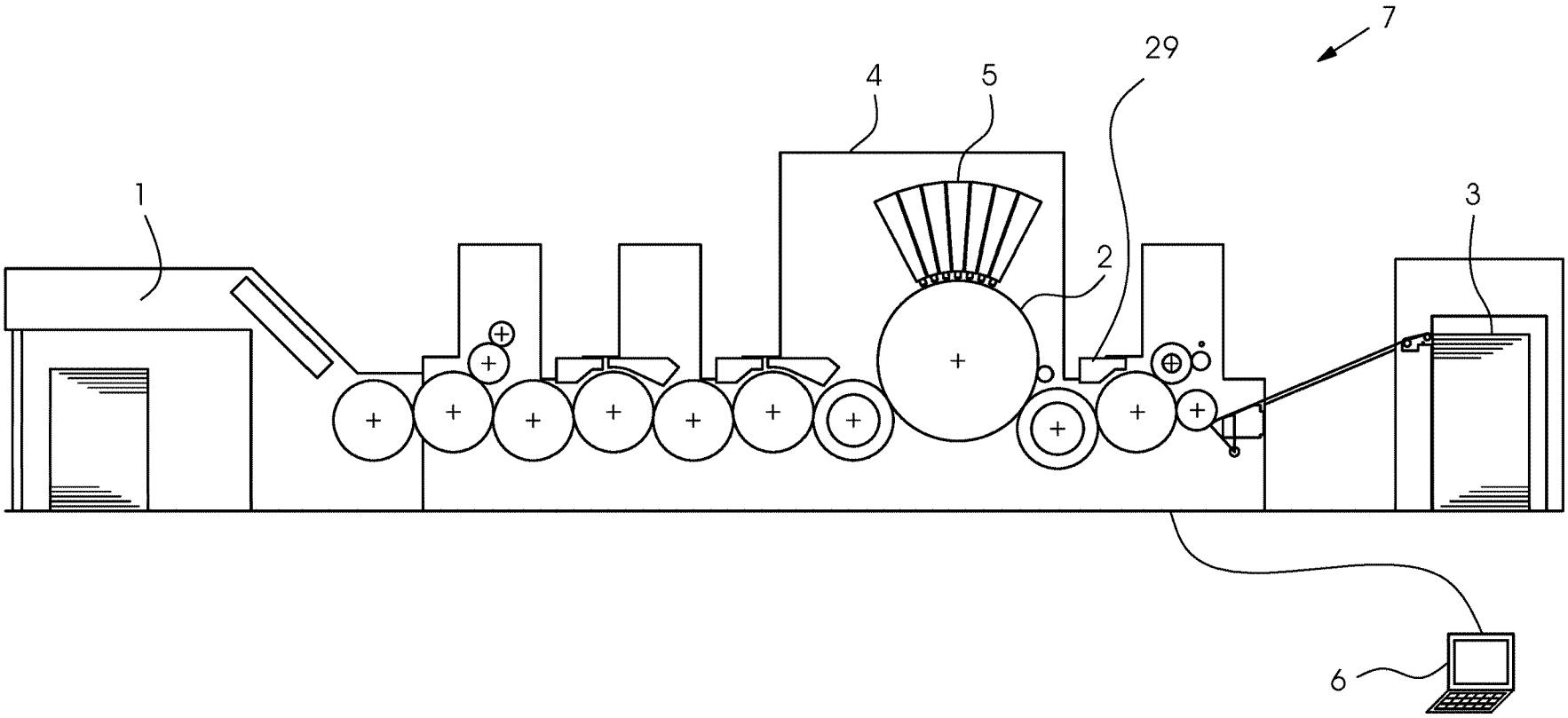
FIG. 1 is a diagrammatic, longitudinal-sectional view of an example of a sheet-fed ink jet printing machine.

Referring now in detail to the figures of the drawings, in which mutually corresponding elements have the same reference symbols, and first, particularly, to FIG. 1 thereof, it is seen that the field of application of the preferred exemplary embodiment is an inkjet printing machine 7. FIG. 1 shows an example of the fundamental construction of such a machine 7, including a feeder 1 for feeding a printing substrate 2, a printing unit 4 in which the printing substrate receives an image printed by print heads 5 and a delivery 3. The machine 7 is a sheet-fed ink jet printing machine 7 controlled by a control unit 6.

Figure 2:
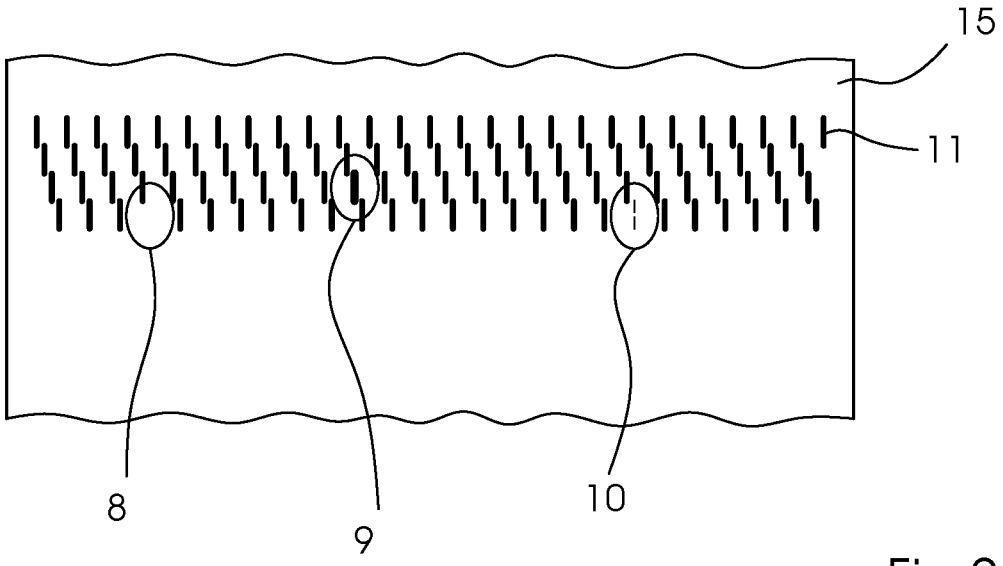
FIG. 2 is a fragmentary, top-plan view of an example of a printing nozzle test chart which is used having horizontal rows of equidistant vertical lines.
Figure 4:
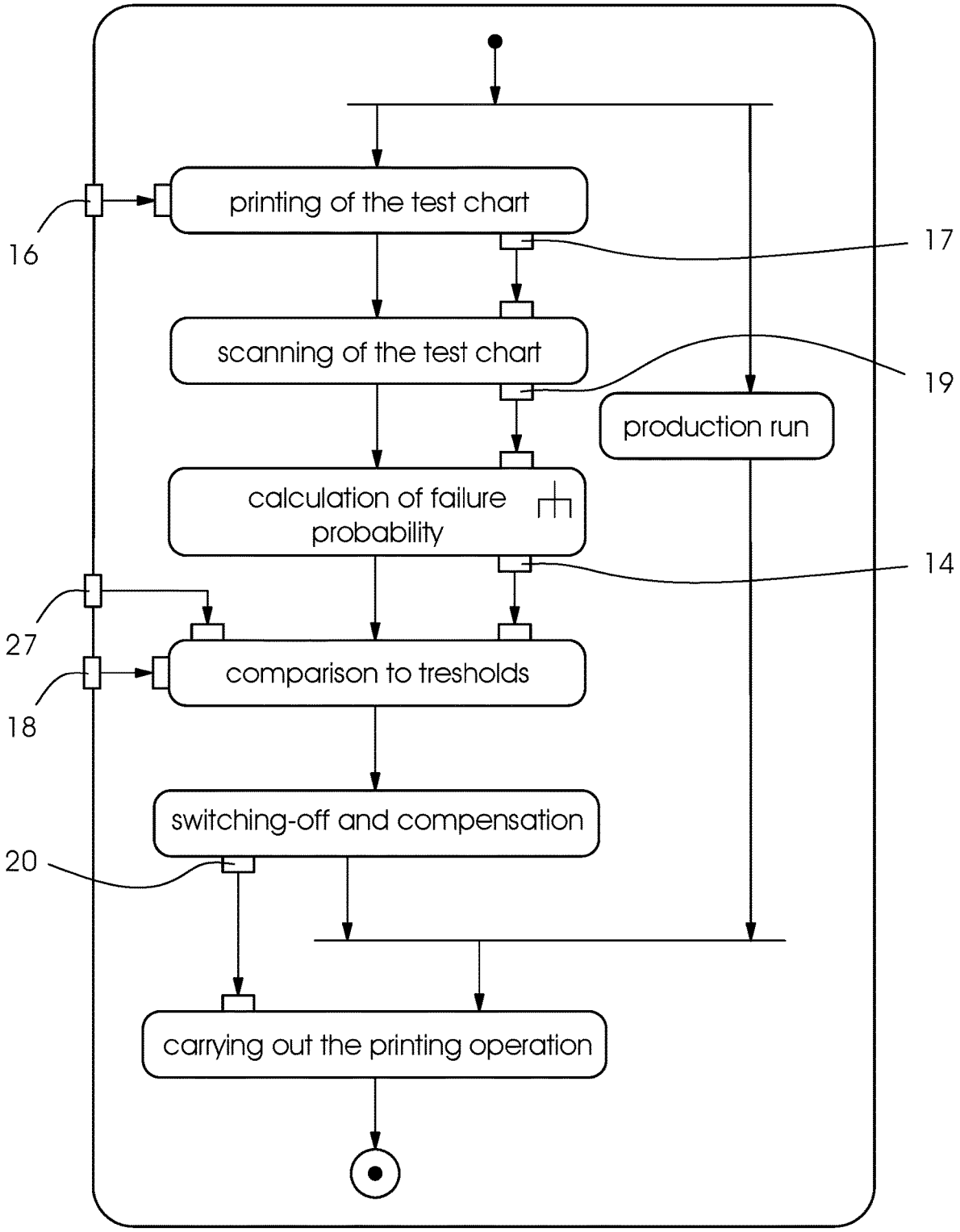
FIG. 4 is a flow chart illustrating the method of the invention.

A preferred embodiment of the method of the invention is shown in FIG. 4. A first step in the processing of the print job is to print a digital printing nozzle test chart 16 or several different ones during a production run. The test chart 16 is formed of multiple horizontal rows of vertical lines 11, with every printing nozzle per print head 5 printing at least one vertical line 11. Such a printed test chart 17 is shown in FIG. 2, where only every $x^{th}$ printing nozzle creates a vertical line 11 in a horizontal row, which means that x horizontal rows need to be printed per printing nozzle test chart 17 for every printing nozzle to create at least one vertical line 11. The figure shows the image objects 11, i.e. the vertical lines 11 that have been printed by defective printing nozzles, for instance an object 8 printed by failed printing nozzles, an object 9 printed by printing nozzles that print in a deviating way, and an object 10 printed by printing nozzles that print a reduced amount of ink. Characteristic values 28 in the form of the thickness, slope, and color value of the vertical lines may be calculated from these particular vertical lines. The utilized capacity of the contributing printing nozzles is also included in the characteristic values 28. At least one image sensor 29 of an image recording system then scans and digitizes the printed test charts 17 and forwards them to the evaluation computer 6. With the aid of the prediction model, the evaluation computer 6 calculates a failure probability 14 of every single printing nozzle that contributed to the printed printing nozzle test chart 17. When the failure probability 14 of a printing nozzle exceeds a set threshold 18, the printing nozzle 20 in question is deactivated and compensated for in the printing of the actual print. Then the actual printing operation to complete the print job continues. The defective printing nozzles 20 that have been detected in a corresponding way in the form of a failure probability 14 available for every printing nozzle are deactivated as a function of the failure probability 14 and thus need to be compensated for. At the same time, compensated printing nozzles 20 that are no longer used to print the actual print because their failure probability 14 was too high continue to be used to print the digital printing nozzle test charts 16 and to be evaluated. If they stay below a corresponding second threshold 27 and are thus usable for printing the actual print, they will be switched on again and no compensation is made.

Figure 3:
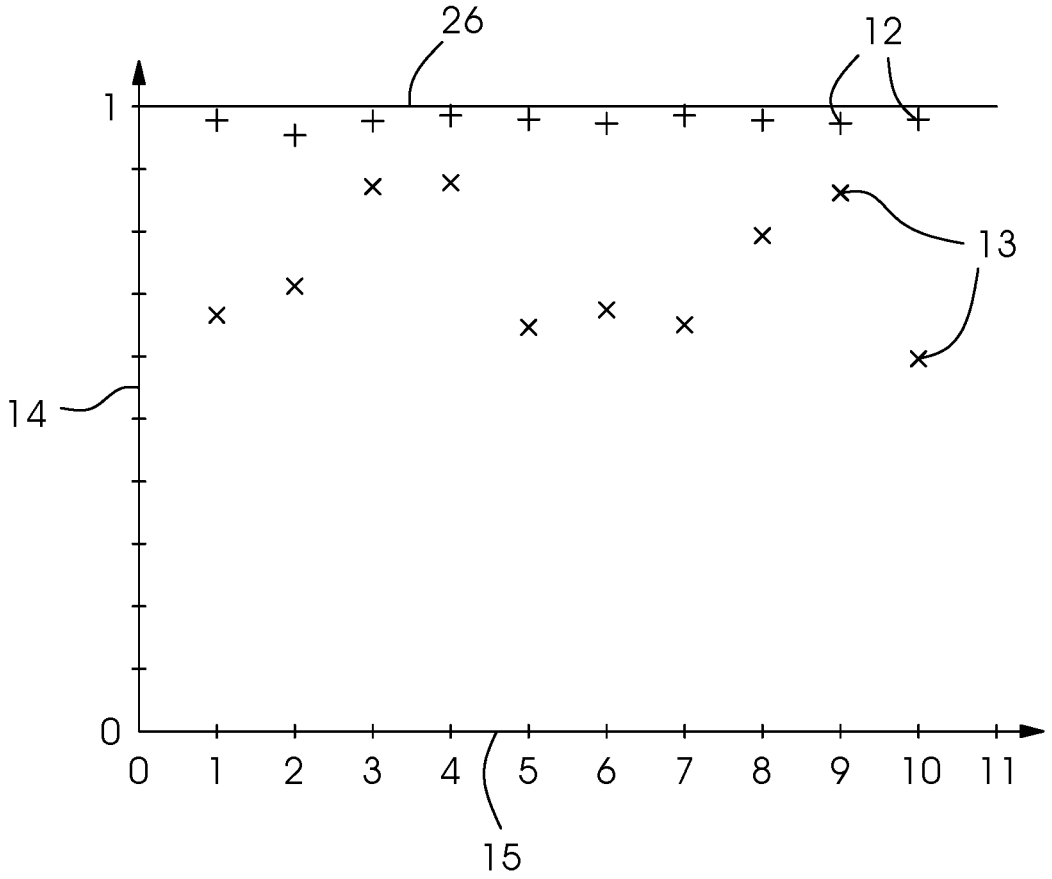
FIG. 3 is a diagram illustrating two examples of a characteristic value progression over time and a corresponding tolerance threshold.
Figure 5:
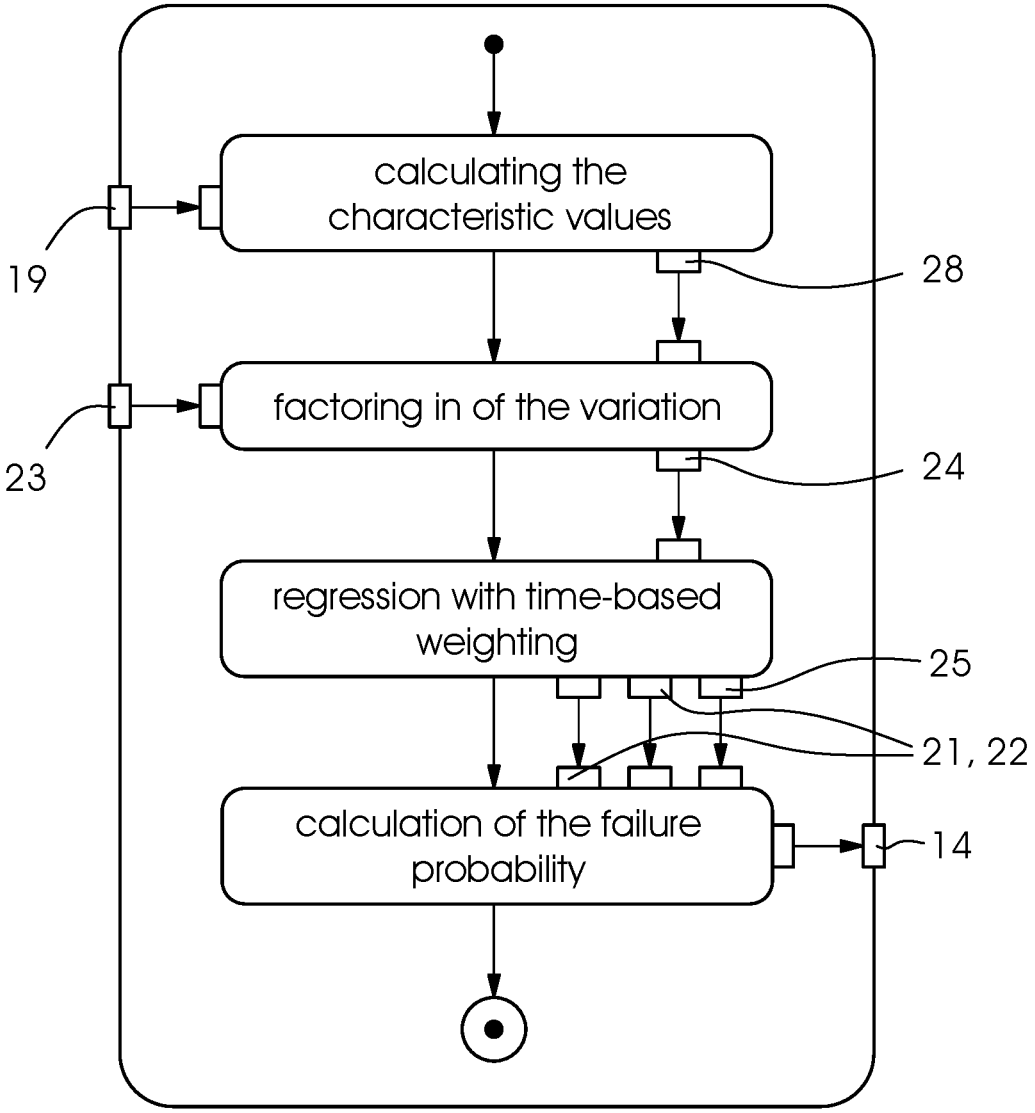
FIG. 5 is a flow chart illustrating a calculation of a failure probability.

The calculation of the failure probability 14 is schematically shown in more detail in FIG. 5. The calculation is formed of calculating the characteristic values 28 that describe the performance of the individual printing nozzles and are obtained from the computer's evaluation of the test charts 19 that have been printed and recorded multiple times. An intrinsic aspect of the method is that characteristic values 28 are treated in accordance with their process variation 23. This means that for the same failure probability 14, progressions with a low variation 23 are allowed to get closer to a tolerance threshold 26 than progressions with greater variation 23. FIG. 3 shows this by way of example for two progressions of characteristic values 28, one with low variation 12, which is allowed to get closer to the tolerance threshold, and one with greater variation 13, which is not. The x-axis of FIG. 3 shows the number of measurements 15 taken to calculate the characteristic values, while the y-axis indicates the failure probability 14. Both characteristic value progressions 12, 13 have a normal distribution and have the same failure probability 14 in terms of the tolerance threshold 26. If this failure probability 14 was just about to exceed the acceptable tolerance threshold 26, both printing nozzles would be switched off even though for the progression that has the wide variation 23, a failure is not yet evident. In a further step, factoring in the variation 23 of characteristic values 24 by using a regression involving a time-based weighting, statistic process factors 21, 22 for determining the failure probability 14 are calculated in the form of an expectation value 21 and a confidence interval 22. In order to calculate the process factors 21, 22 by regression, a progression over time of the individual characteristic values 25 is factored in in the weighting. These process factors 21, 22 are then used to calculate the failure probability 14 by comparing the characteristic value progression to the tolerance threshold 26. The failure probability value 14 is determined by the probability of whether the future progression of the characteristic values 24, 25 that may be derived from the process factors 21, 22 will exceed the tolerance limit 26.

Figure 6:
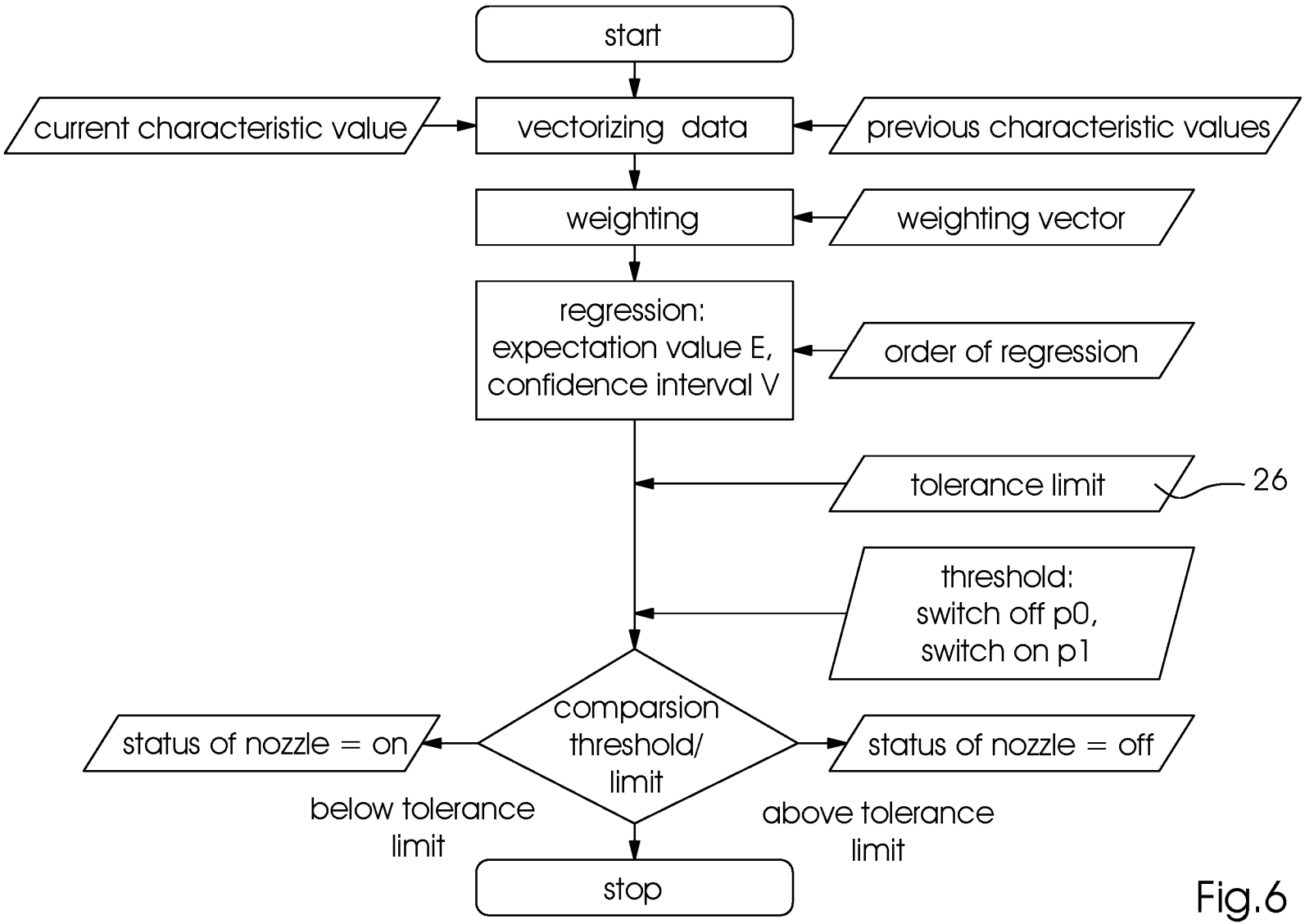
FIG. 6 is a flow chart illustrating a prediction model.

The prediction model that is applied itself will be explained in more detail with reference to FIG. 6. The model is based on the known prior art process of establishing suitable characteristic values 28 for every printing nozzle in an ongoing print run. This means that for every printing nozzle, the last n (e.g. five) measured values are saved and processed. The characteristic values 28 of the printing nozzles follow a statistic distribution, ideally a normal distribution. Based on the assumption that the characteristic values are normally distributed, the probability 14 of the print quality tolerance threshold 26 to be exceeded may be calculated in a statistic calculation. It is no longer purely measured values that are used but statistic process factors 21, 22, preferably expectation value 21 and confidence interval 22. Thus, for every printing nozzle, there is an expectation value 21 and a confidence interval 22, which allow the failure probability 14 of every printing nozzle to be determined. When a specific threshold $p_0$ 18 such as 1% failure probability 14 is exceeded, the printing nozzle 20 is switched off. It is likewise possible to switch a switched-off nozzle 20 back on when its failure probability 14 drops below a specific threshold $p_1$ 27 such as 1% failure probability 14. The two thresholds $p_0$ 18 and $p_1$ 27 may or may not have the same value. In this context, $p_0$ will always be less than or equal to p1.

The statistic process factors 21, 22 are calculated by regression, e.g. linear or non-linear regression, from the time series of n values. If n=1, the method becomes the known prior art method. The regression model that is used may be of any desired (i.e. $n^{th}$) order. Typically, however, it will be of $1^{st}$ order for a linear regression. For a regression model of zero order, there is no regression, the statistic process factors of expectation value 21 and confidence interval 22 correspond to the average and the standard deviation.

The statistic process factors 21, 22 may be created with or without a time-based weighting of the values of the n measurements. In this context, any desired time-based weighting may be applied. If it is applied, newer data will typically have a higher weighting than older data, namely in the form of a linear or exponential weighting.

A further preferred embodiment of the prediction model may be created when the behavior of the n measured values over time is factored in. In this case, based on the regression, an extrapolation is made for the next expectation value 21 and the corresponding confidence interval 22.

A typical implementation appears as follows:

Number of measured values, n: 1 to 100, typically 10.

Threshold p0: 0.01% to 50% failure probability, typically 1%.

Threshold p1: 0.01% to 50% failure probability, typically 1%.

In a nutshell, this means that based on a time series analysis of the values of the characteristics of the printing nozzles and the inference-statistic analysis thereof with closing statistics, the future development of the performance of the printing nozzles including the associated failure probabilities 14 in the form of uncertainties/confidence intervals may be predicted in accordance with the aid of the prediction model in accordance with the method of the invention. This is a way to make a decision whether a printing nozzle is to be switched on or whether it is to be switched off and compensated for before it may produce waste in the form of unacceptable prints.

A further preferred embodiment of the method of the invention relates to the statistic evaluation of the measured data. Apart from a unimodal distribution of the characteristic values 28 of a printing nozzle, a multimodal distribution may be assumed. When a unimodal distribution is assumed in the specific case of a normal distribution, the characteristic values 28 of the printing nozzles may be described with sufficient accuracy.

When a multimodal distribution is assumed, the following applies: Since only a very limited number of measured values is available, it is necessary to estimate the distribution function from which the failure probabilities 14 may then be differentiated. If the distribution function is known, the failure probability 14 may be determined by numerical integration of the distribution function. One possible way of estimating the density function is to use a so-called kernel density estimation.

In the embodiment described above involving unimodal distribution, the statistics of the individual nozzle is described, for instance, by an average and the standard deviation when a normal distribution is assumed. The failure probability 14 is then calculated therefrom. At a normal distribution, a value that has a failure probability 14 of 1%, for instance, corresponds to the average or expectation value 21 multiplied by the 2,576-fold of the standard deviation. In the case of regression, this works in an analogous way for the confidence interval 22.

For a multimodal distribution, the determination of the failure probability 14 is done purely numerically. Initially, the distribution function is estimated in a numeric process and subsequently, the failure probability 14 is obtained by a numeric integration of the distribution function.

The following is a summary list of reference numerals and the corresponding structure used in the above description of the invention:

1 feeder
2 printing substrate
3 delivery
4 ink jet printing unit
5 ink jet print head
6 computer
7 ink jet printing machine
8 failed printing nozzle
9 printing nozzle that prints incorrectly
10 printing nozzle that prints a reduced amount
11 printing nozzle image object
12 characteristic value progression with little variation
13 characteristic value progression with great variation
14 failure probability
15 number of measuring processes for characteristic value calculation
16 digital test chart
17 printed test chart
18 threshold for switching off a printing nozzle
19 printed and recorded test chart
20 printing nozzles that have been switched off and compensated for
21 statistic process factor of expectation value
22 statistic process factor of confidence interval

23 characteristic value variation
24 characteristic values factoring in variation
25 characteristic values factoring in regression and variation
26 tolerance limit for characteristic values
27 threshold for switching a printing nozzle on again
28 characteristic values

The invention claimed is:

1. A method for detecting and compensating for failed printing nozzles in an ink jet printing machine by using a computer, the method comprising the following steps:

carrying out printing of printing nozzle test charts next to an actual print during a production run and subsequently recording and digitizing the printed printing nozzle test charts by using at least one image sensor;

evaluating the recorded test charts and, based thereon, determining characteristic values for all printing nozzles contributing to the printing of the printing nozzle test chart by using the computer;

calculating a failure probability for every contributing printing nozzle based on the determined characteristic values by applying a statistical prediction model by using the computer;

for the application of the prediction model, establishing the characteristic values for every printing nozzle multiple times, with every evaluation of the printed printing nozzle test chart corresponding to one pass, and saving and using the characteristic values having been established multiple times to calculate the failure probability;

switching off all printing nozzles exceeding a first defined threshold for the calculated failure probability and compensating for the switched-off nozzles; and carrying out a printing operation on the ink jet printing machine with printing nozzle compensation.

2. The method according to claim 1, which further comprises printing the printing nozzle test chart by forming a specified number of horizontal rows of equidistant vertical lines printed periodically and disposed underneath one another, and providing every row of the nozzle test chart with only those printing nozzles of the print head of the ink jet printing machine corresponding to the specified number of the horizontal rows periodically contributing to a first element of the printing nozzle test chart.

3. The method according to claim 2, which further comprises including thickness, slope and color value of the vertically printed equidistant lines as well as a utilized capacity of the contributing printing nozzles in the characteristic values.

4. The method according to claim 1, which further comprises using the failure probability of every one of the printing nozzles to represent a probability that a printing nozzle will exceed a tolerance limit for print quality resulting from the characteristic values.

5. The method according to claim 1, which further comprises using the characteristic values having been established multiple times as a function of a process variation of the characteristic values over a progression of individual passes, and for the same failure probability, allowing the characteristic values of progressions of lower process variation of the characteristic values to get closer to a tolerance limit than progressions of greater process variation.

6. The method according to claim 5, which further comprises converting the characteristic values having been established multiple times into statistical process factors forming an expectation value and a confidence interval, determining the statistical process factors by linear or non-linear regression of the characteristic values having been established multiple times, and using a regression model of any desired order for the linear or non-linear regression.

7. The method according to claim 6, which further comprises creating the statistical process factors with a time-based weighting of the characteristic values having been established multiple times, and carrying out the time-based weighting by causing newer characteristic values to have a linearly or exponentially higher weight than older characteristic values.

8. The method according to claim 1, which further comprises calculating the failure probability for all printing nozzles contributing to the printing of the printing nozzle test charts by assuming and using multimodal distributions of the characteristic values in addition to a unimodal distribution of the characteristic values.

9. A method for detecting and compensating for failed printing nozzles in an ink jet printing machine by using a computer, the method comprising the following steps:

carrying out printing of printing nozzle test charts next to an actual print during a production run and subsequently recording and digitizing the printed printing nozzle test charts by using at least one image sensor;

evaluating the recorded test charts and, based thereon, determining characteristic values for all printing nozzles contributing to the printing of the printing nozzle test chart by using the computer;

calculating a failure probability for every contributing printing nozzle based on the determined characteristic values by applying a statistical prediction model by using the computer;

switching off all printing nozzles exceeding a first defined threshold for the calculated failure probability and compensating for the switched-off nozzles;

allowing printing nozzles having been switched off for the printing of the actual print to still contribute to the printing of the printing nozzle test charts;

continuing to calculate a failure probability for the switched off printing nozzles;

again using the switched off printing nozzles for printing the actual print in the production run if the calculated failure probability stays below a second defined threshold; and carrying out a printing operation on the ink jet printing machine with printing nozzle compensation.

* * * * *